United States Patent [19]

Rajan et al.

[11] Patent Number: 5,051,656

[45] Date of Patent: Sep. 24, 1991

[54] TRAVELLING-WAVE TUBE WITH THERMALLY CONDUCTIVE MECHANICAL SUPPORT COMPRISING RESILIENTLY BIASED SPRINGS

[75] Inventors: Sunder S. Rajan, Anaheim; Roger S. Hollister, Torrance; Thomas P. Carlisle, Rolling Hills Estates, all of Calif.

[73] Assignee: Hughes Aircraft Company, Los Angeles, Calif.

[21] Appl. No.: 402,723

[22] Filed: Sep. 5, 1989

[51] Int. Cl.[5] ..... H01J 23/24

[52] U.S. Cl. ..... 315/3.5; 315/39.3; 29/600

[58] Field of Search ..... 315/3.5, 3.6, 39.3, 315/39 TW; 333/156, 162; 29/600, 601

[56] References Cited

U.S. PATENT DOCUMENTS

| | | | |
|---|---|---|---|
| 2,853,644 | 9/1958 | Field | 315/3.5 |
| 2,943,228 | 6/1960 | Kleinman | 315/3.5 |
| 3,209,198 | 9/1965 | Long et al. | 315/39.3 X |
| 3,268,761 | 8/1966 | Mann | 315/3.6 |
| 3,466,493 | 9/1969 | Phillips | 333/81 R X |
| 3,505,616 | 4/1970 | Picquendar et al. | 315/3.5 X |
| 3,514,843 | 6/1970 | Cernik | 29/599 |
| 3,540,119 | 11/1970 | Manoly | 29/600 |
| 3,735,188 | 5/1973 | Anderson et al. | 315/3.5 |
| 4,712,293 | 12/1987 | Manoly | 29/600 |
| 4,712,294 | 12/1987 | Lee | 29/600 |

FOREIGN PATENT DOCUMENTS

| | | | |
|---|---|---|---|
| 191939 | 11/1982 | Japan | 315/3.5 |

*Primary Examiner*—Eugene R. LaRoche
*Assistant Examiner*—Benny T. Lee
*Attorney, Agent, or Firm*—Terje Gudmestad; Walder Jeannette M.; Wanda K. Denson-Low

[57] ABSTRACT

In a travelling-wave tube (20), a cylindrically-shaped slow-wave circuit cavity-defining member (34) is supported by and is thermomechanically bonded to a tubularly-configured vacuum wall member (32). The bonded joint comprises a pair of arcuate grooves (52) extending lengthwise of the slow-wave circuit and positioned diametrically opposite one another about the axis of the tube. A helical or wavy spring (54, 58) lies in each groove and is resiliently biased in intimate mechanical and thermal contact between the groove and the vacuum wall. The helical spring, in particular, can be used as a conduit for exhaust of gases from the travelling-wave tube during its fabrication.

13 Claims, 4 Drawing Sheets

Fig. 2.
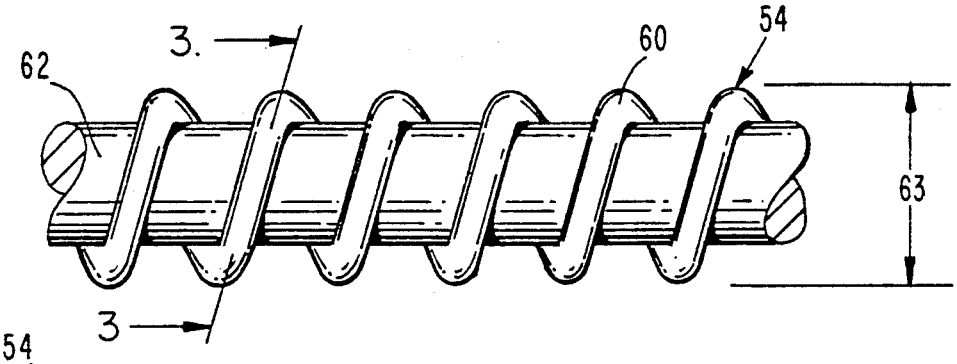
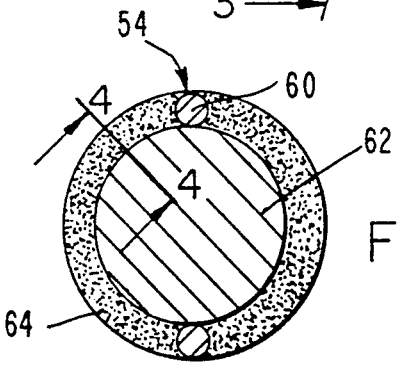
Fig. 3.
Fig. 4.
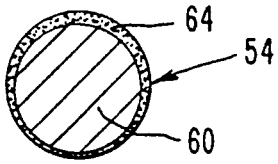
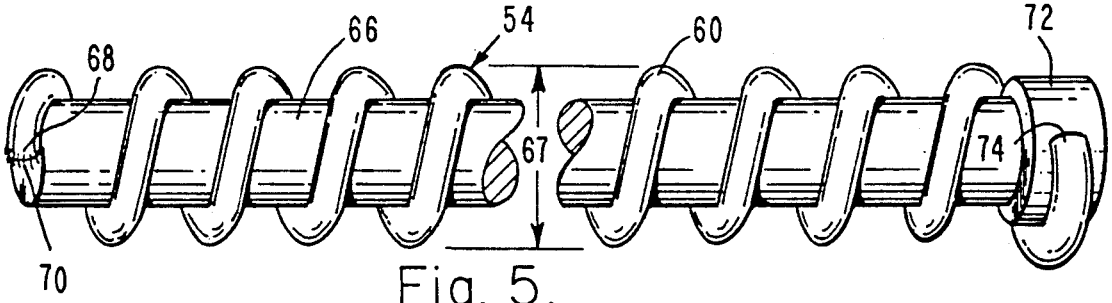
Fig. 5.
Fig. 6.
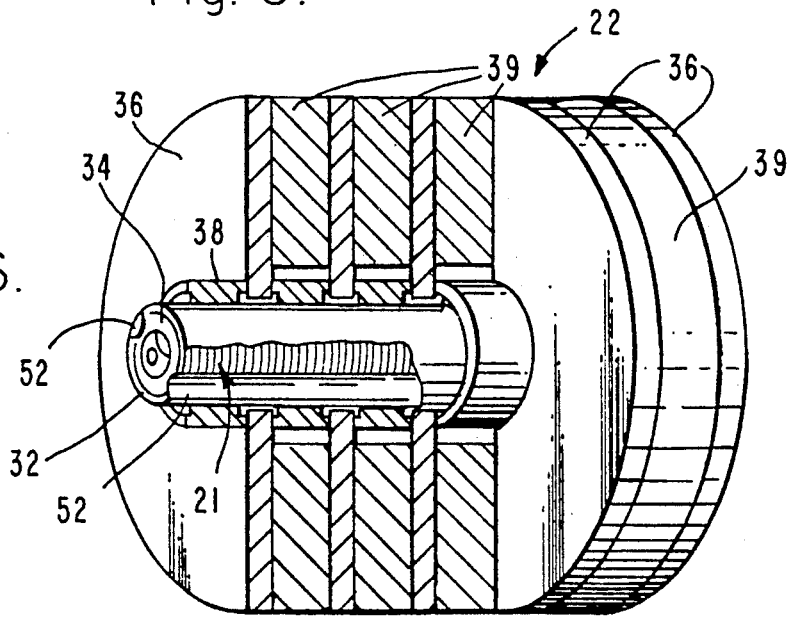

Fig 7.
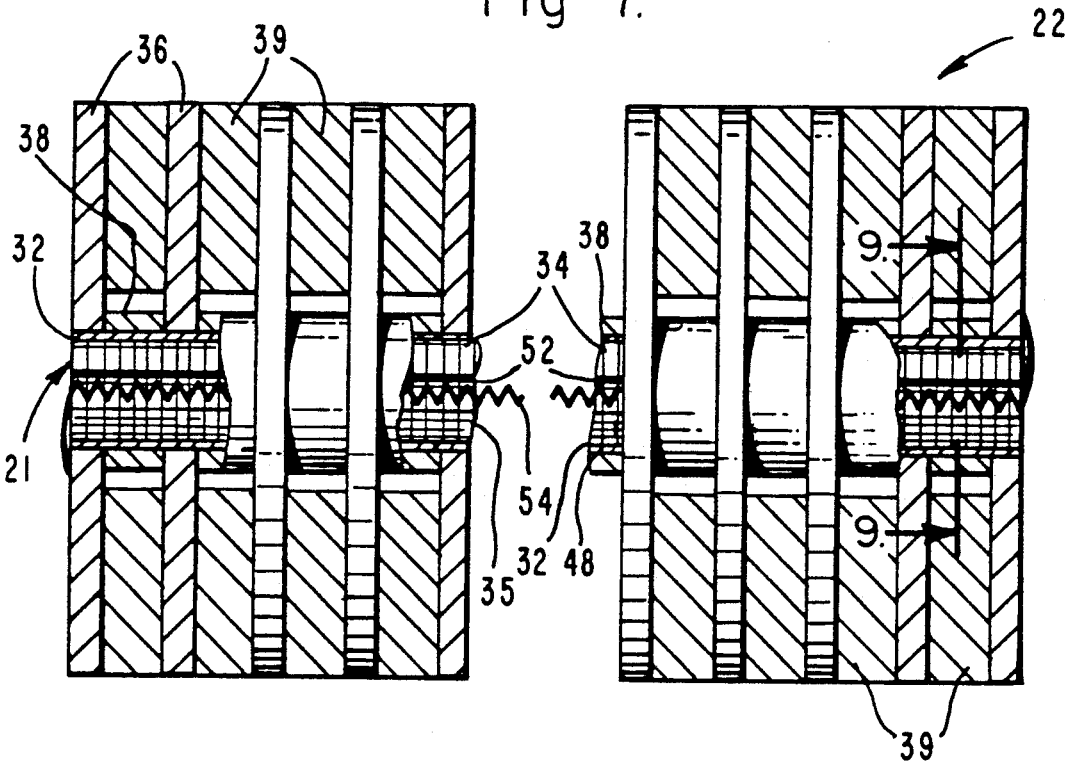
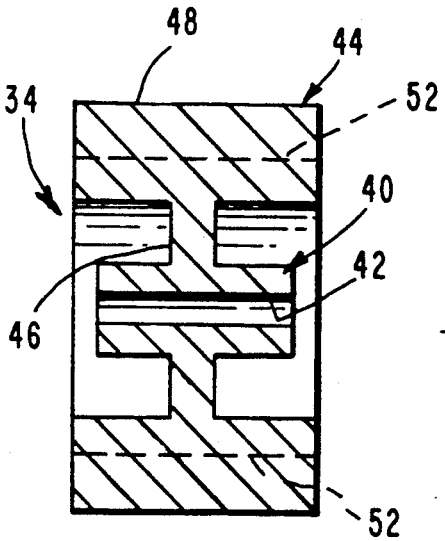
Fig. 8.
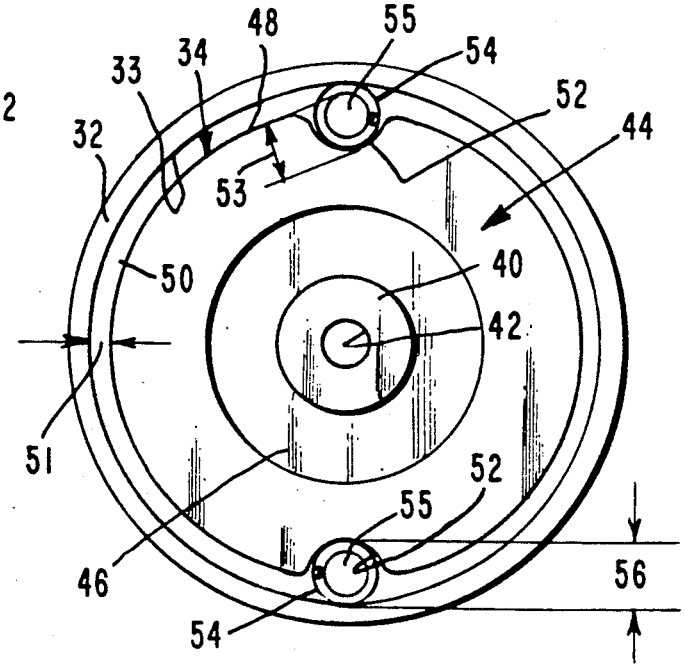
Fig. 9.

Fig. 11.
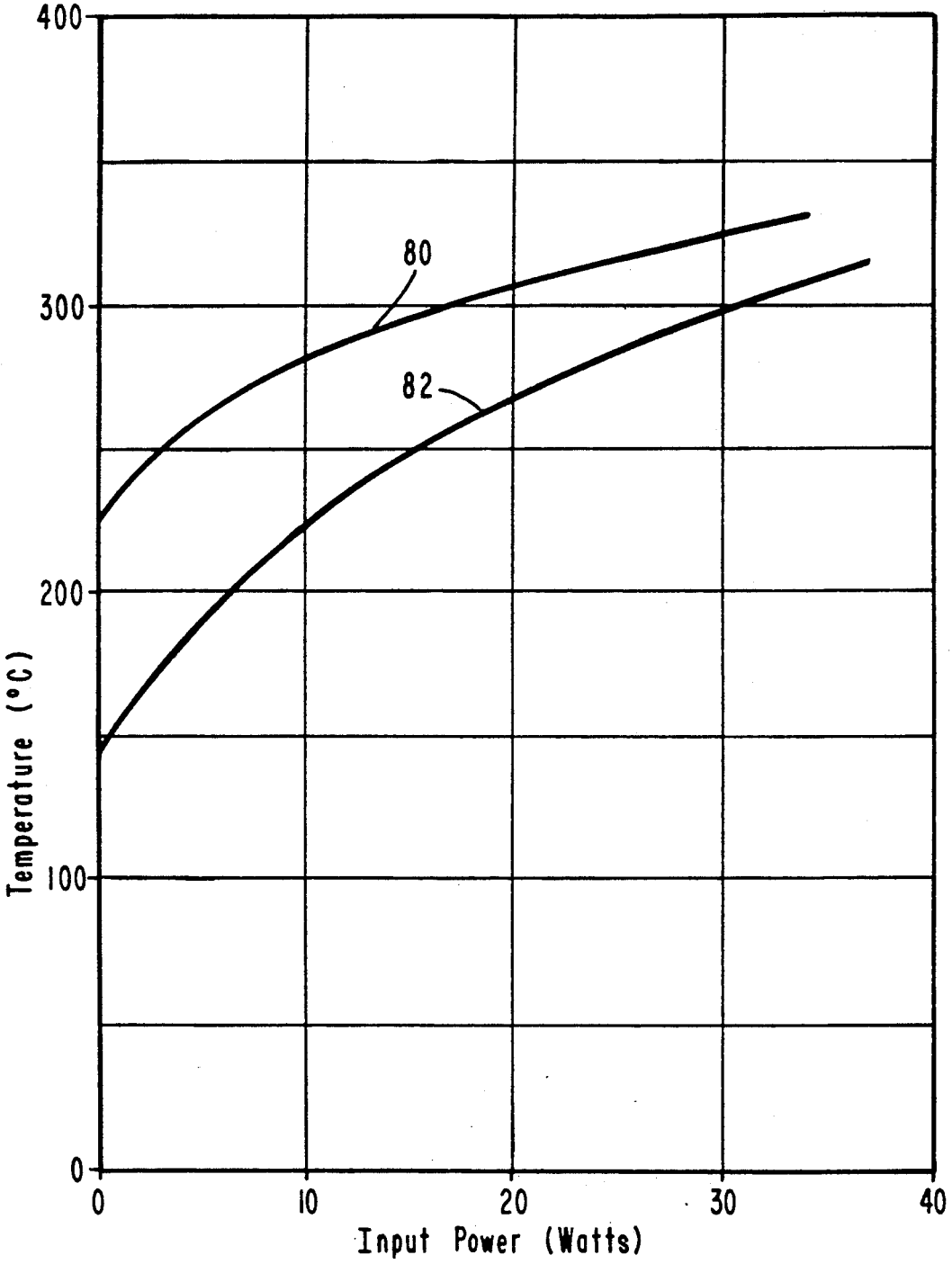
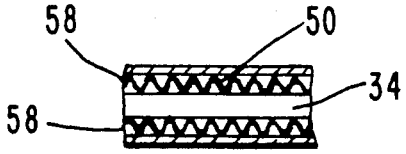
Fig. 10.

TRAVELLING-WAVE TUBE WITH THERMALLY CONDUCTIVE MECHANICAL SUPPORT COMPRISING RESILIENTLY BIASED SPRINGS

This invention was made with Government support under a contract awarded by the Government. The Government has certain rights in this invention.

BACKGROUND OF THE INVENTION

The present invention relates to an apparatus and method for improved thermal conductivity and mechanical support between structures in travelling-wave tubes and, additionally and in combination, for providing shock-resistance and vacuum exhaust in travelling-wave tubes.

In travelling-wave tubes a stream of electrons is caused to interact with a propagating electromagnetic wave in a manner which amplifies the electromagnetic energy. To achieve such interaction, the electromagnetic wave is propagated along a slow-wave structure, or circuit section. The circuit section is housed by a wall in a vacuum environment. A conventional circuit section may include a conductive helix wound about the path of the electron stream or a folded waveguide type of structure. The latter structure also may be known as a coupled cavity or interconnected-cell type. Regardless of its specific configuration, a waveguide is effectively wound back and forth across the path of the electrons. The slow-wave structure provides a path of propagation for the electromagnetic wave which is considerably longer than the axial length of the structure and, hence, the travelling wave may be made to effectively propagate at nearly the velocity of the electron stream. The interactions between the electrons in the stream and the travelling wave cause velocity modulations and bunching of electrons in the stream. The net result may then be a transfer of energy from the electron beam to the wave travelling along the slow-wave structure.

In the coupled-cavity type of slow-wave structure, a series of interaction cells, or cavities, are disposed adjacent to each other sequentially along the axis of the tube. The electron stream passes through each interaction cell, and electromagnetic coupling is provided between each cell and the electron stream. Each interaction cell is also coupled to an adjacent cell by means of a coupling hole at the end wall defining the cell. The travelling-wave energy traverses the length of the tube by entering each interaction cell from one side, crossing the electron stream, and then leaving the cell from the other side, thus travelling a sinuous or serpentine, extended path.

To function properly, such travelling-wave tubes must operate within an acceptable temperature range and, therefore, the heat generated in the circuit section must be removed. Thus, the circuit section must be supported in intimate thermal contact with the vacuum wall by some form of mechanical bond in order to conduct the heat from the circuit section to a heat sink thermally coupled to the vacuum wall.

Conventional thermomechanical bonds may be formed by brazing, heat shrinking, crimping, coining and clamping, as described in U.S. Pat. Nos. 3,268,761 (brazing or spot-welding), 3,540,119 (heat shrinking), 4,712,293 (crimping), 4,712,294 (coining) and 3,514,843 (clamping). A further U.S. Pat. No. 2,943,228 claims a simplified clamp lacking such means for joining parts as welds, brazes, or other metal flow processes. Notwithstanding, under conditions of high heat load, these bonding techniques may contribute to a potential decrease in performance of the travelling-wave tube, for example, by an adverse change in the circuit RF match, in the event that the structure of one or both of the joined elements deform by exertion of pressure from the bond, by stress resulting from changes in temperature, humidity and the environment, or by contamination from braze alloy and the like. Thus, it is desired that any such decreased performance be avoided.

SUMMARY OF THE INVENTION

Accordingly, the present invention provides a thermomechanical bond as a resiliently biased bond, specifically, as a helically shaped or wavy spring. By bonding the spring at its external surfaces to the vacuum wall and the circuit section, both an intimate mechanical and thermal contact and a vibration and shock resistant mounting for the circuit section is effected. In addition, the helical spring, in particular, can be used as a conduit for exhaust of gases from the travelling-wave tube during its fabrication.

Several advantages are derived from this arrangement. Any adverse effect on the circuit RF match is minimal. The circuit sections are protected from deformation and damage and, in addition, are protected from shock and vibration. Heat transfer is improved and the temperature of the circuit sections is lowered. The circuit sections can be symmetrically supported. Fabrication of the travelling-wave tube is facilitated, including the establishment of a vacuum therein. Compression of the circuit sections can be precisely controlled by judicious selection of the spring material and its configuration. Prevention of contamination can be better controlled.

Other aims and advantages, as well as a more complete understanding of the present invention, will appear from the following explanation of exemplary embodiments and the accompanying drawings thereof.

DESCRIPTION OF THE DRAWINGS

FIG. 2 illustrates a method of using a mandrel for forming one of the helical springs of the embodiment of FIG. 1;

FIG. 3 is a cross-section of the spring and mandrel taken along line 3—3 of FIG. 2;

FIG. 4 is an enlarged cross-sectional view of the spring and mandrel depicted in FIGS. 2 and 3 taken along line 4—4 of FIG. 3;

FIG. 5 shows the helical spring wound on a wire or spindle of lesser diameter than that of the mandrel for reducing the diameter of the spring in preparation for its insertion within a groove in the circuit section;

FIG. 6 illustrates the insertion of the reduced diameter spring within the groove between the circuit section and the vacuum wall of the travelling-wave tube;

FIG. 7 depicts the helical spring inserted in the travelling-wave tube and secured at its ends to pole pieces supported on the vacuum wall;

FIG. 8 shows a segment of the circuit section having diametrically opposed grooves therein;

FIG. 9 is an enlarged cross-sectional view of the circuit section segment of FIG. 7 taken along line 9—9 thereof;

FIG. 10 is a modification of the spring configured as a wavy spring; and

FIG. 11 is a comparison of temperature versus input power data derived from tests on circuit sections in which a helical spring was and was not used to experimentally verify that the present invention provides improved heat transfer and a lower circuit temperature.

DETAILED DESCRIPTION OF THE PREFERRED EMBODIMENTS

Figure 1:
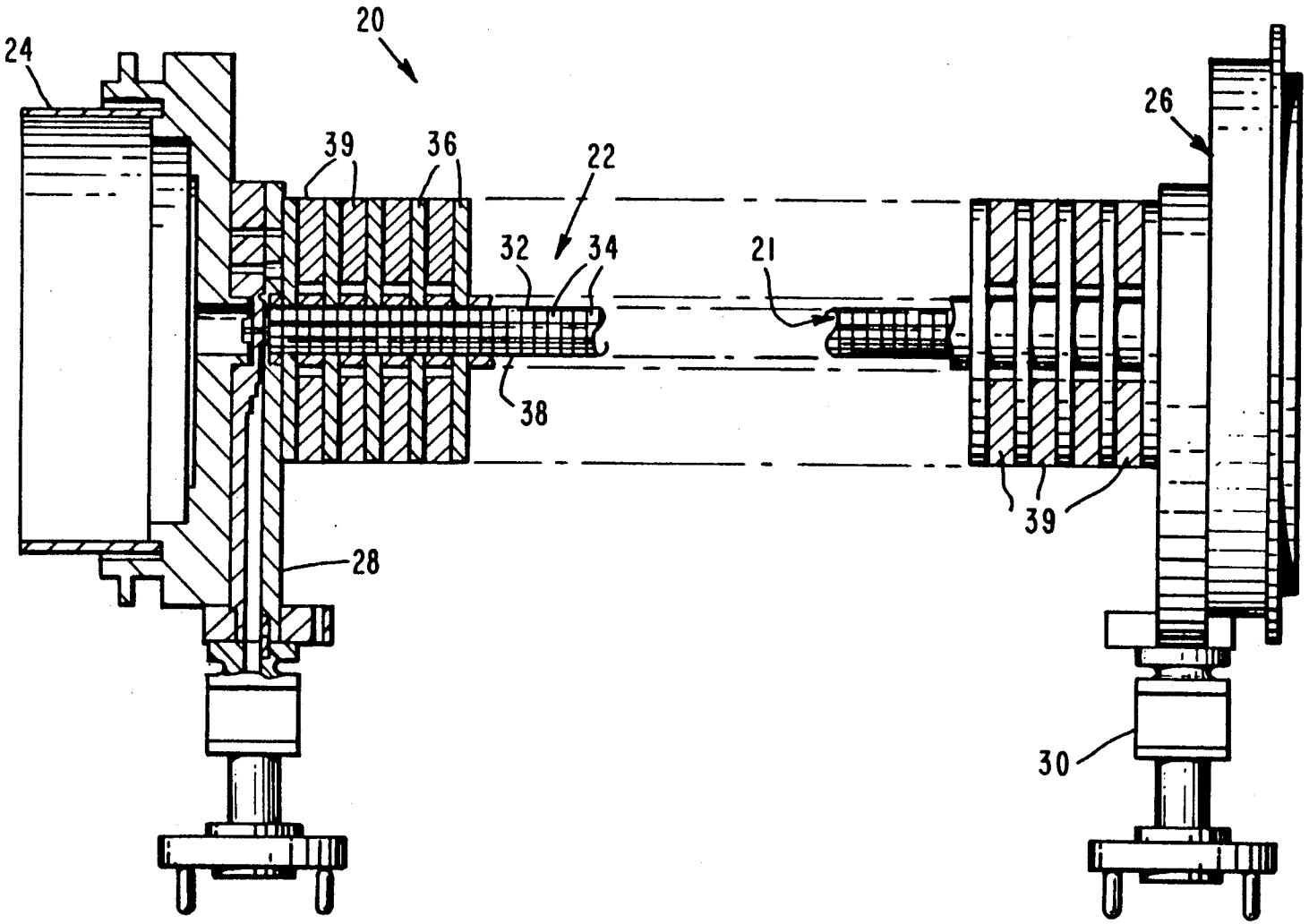
FIG. 1 is a view in partial cross-section of a travelling-wave tube incorporating a preferred embodiment of the present invention comprising a pair of helical springs thermally and mechanically supporting a circuit section within a vacuum wall of the travelling-wave tube.

Referring to FIG. 1, a travelling-wave tube 20 includes a slow-wave structure 21 within a magnetic focusing assembly 22, and housings 24 and 26 at opposite ends thereof for respective housing of an electron gun and a collector electrode (not shown). Input and output waveguides 28 and 30 are coupled to the respective ends of slow-wave structure 21.

As shown also in FIGS. 6–8, slow-wave structure 21 has an outer vacuum vacuum wall member 32, and a plurality of serially positioned cavity-defining members 34 (see FIG. 8, in particular) coaxially and sequentially housed within vacuum wall member 32. Focusing assembly 22 includes a series of outwardly extending pole pieces 36 secured to vacuum wall 32 by spacers 38. A series of magnets 39 are disposed between respective pairs of adjacent pole pieces 36 radially outwardly of respective spacers 38.

As shown in FIG. 8, each cavity-defining member 34 has a drift tube or ferrule 40 provided with a tubular opening 42 extending along the axis of slow-wave structure 21. Cavity-defining member 34 further includes an annularly shaped outer portion 44 to which drift tube 40 is secured by a web 46 and which is bounded by a periphery 48. As best illustrated in FIG. 9, periphery 48 is spaced from inner surface 33 of vacuum wall member 32 to provide an annular space 50 therebetween having a gap 51 whose radial dimension may be between 5 and 7 mils. A pair of diametrically opposed grooves 52 of depth 53 are formed in annular outer portion 44. A pair of axially extending helical springs 54, which define interiors 55 (shown in FIG. 9), reside in respective grooves 52. As discussed below, interiors 55 are used to advantage in the assembly of travelling-wave tube 20. Each spring 54 has a normal diameter which is greater than distance 56 which is the sum of the cross-sectional extent of groove 52 and gap 51 so that spring 54 is compressed and thus forms a resilient, firm thermomechanical joint between each cavity-defining member 34 and vacuum wall member 32. If desired, springs 54 may be bonded at their external peripheries to grooves 52 and surface 33.

Springs 54 may take any desired shape, a helix being preferred; however, they may be configured as wavy springs 58, as illustrated in FIG. 10. Also, while grooves 52 are shown as paired in diametrical opposition in cavity-defining member 34, any further number of grooves may be used, and this further number need not be evenly spaced from one another about periphery 48, so long as springs 54 or 58 provide the desired thermomechanical joint between surface 33 of vacuum wall 32 and periphery 48 of cavity-defining member 34.

Fabrication of the springs, and assembly of the thermomechanical joint may be effected in any suitable manner. The following technique has been found to be effective, and is based upon successfully made, actual joints in a radially-dimensioned gap 51 of 5–7 mils. As illustrated in FIGS. 2–5, a wire 60 of suitable material, such as of molybdenum, tungsten, rhenium, dispersion hardened copper, and an alloy of tungsten and rhenium is wound on a mandrel 62 as shown in FIGS. 2 and 3. The diameter of spring 54 on mandrel 62 is designated by indicium 63 (see FIG. 2). For travelling-wave tube use, the preferred wire is a doped, non-sag grade of molybdenum, which does not recrystallize and become brittle as easily as the non-doped material. The resultant wound spring is made longer than that of groove 52 into which it is to be placed, for reasons which will become evident. While the spring is still attached to mandrel 62, a plate 64 (see FIG. 4), comprising gold over a strike of nickel, is formed on the exterior surfaces of the spring; it is not necessary that the plate exist on the interior of the spring.

As depicted in FIG. 5, spring 54 is then removed from the mandrel and slipped over a spindle 66 having a lesser diameter than that of the mandrel. Like spring 54, spindle 66 has a length which exceeds that of grooves 54. Spring 54 is then secured at one end 68 to spindle 66 by a spot weld 70, and tightly wound about spindle 66 to decrease the spring's diameter from its former larger diameter 63 to a value, denoted by indicium 67, which is less than the combined cross-sectional extent of groove 52 and gap 50 (denoted by indicium 56 shown in FIG. 9). The other end 74 of spring 54 is clamped to spindle 66 by a collet 72.

Each spring 54, as secured to its spindle 66, is then inserted into the space formed by groove 52 and gap 51 as shown in FIG. 6 and indicated by arrows 76, until both wire ends 68 and 74 extend beyond the respective ends of the assembly of cavity-defining members 34. If desired, the spring-spindle assembly may be turned, and therefore threaded, as an aid to its insertion. With the ends extending beyond the respective ends of the assembly of members 34, spindle 66 is rotated and twisted in the direction opposite from the threading direction to permit spring 54 to expand into engagement with the walls of groove 52 and vacuum wall member 32. Weld joint 70 is broken and collet 72 is removed to release spring 54 from spindle 66, which is then removed, thus leaving spring 54 inside its groove 52 with a mechanical interference contact with vacuum wall member 32 on one side and all cavity-defining members 34 on the other.

The spring length is then cut to size to the length of the assembly of cavity-defining members 34, and the cut ends of the springs are secured to the respective end pole pieces 36 by spot brazing using a shim, e.g., of palladium-cobalt alloy.

The thus-fabricated and enclosed vacuum assembly is heated and otherwise processed in a conventional manner to exhaust its interior to a vacuum, as well as to provide a metallurgical diffusion of gold into the surfaces of vacuum wall member 32 and cavity-defining members 34 in contact with springs 54. As an aid in exhausting the assembly, interiors 55 of springs 54 act as conduits for removal of gases.

The dimensions of the components used in a typical assembly to form a thermomechanical joint for radially-dimensioned gap 51 of 5–7 mils were as follows. Wire 60 comprised a 0.006"±0.0001" diameter doped, non-sag molybdenum wire. Mandrel 62 was formed of tungsten having a diameter of 0.0190"+0.0000" and −0.0002". Wire 60 was precision wound about mandrel 62 to a constant pitch of 0.0169"±0.0002". Spindle 66 comprised a 0.015" diameter nickel wire.

As shown in FIG. 11, curves 80 and 82 represent test data taken on circuit sections respectively without any spring support and with the support of helical spring 54 of the present invention. The comparison of temperature versus input power data derived from the tests on circuit sections experimentally verify that the present invention provides improved heat transfer and the lowering of the circuit temperature.

Although the invention has been described with respect to particular embodiments thereof, it should be realized that various changes and modifications may be made therein without departing from the spirit and scope of the invention.

We claim:

1. In a travelling-wave tube having a substantially cylindrically-shaped circuit section and a support for the circuit section, a method for forming a thermally conductive support between the circuit section and the support comprising the steps of:

forming a resilient biasing means, wherein said resilient biasing means comprises a spring, said biasing means having a specified radial dimension;

forming a groove having a specified radial dimension in the circuit section, wherein a space is formed between the circuit section and the support, wherein said biasing means radial dimension is greater than that defined by the space;

placing the biasing means under stress for reducing its dimension to less than that defined by the space;

inserting the reduced dimensioned biasing means into the space; and releasing the stress from the biasing means for permitting the biasing means to intimately contact the circuit section and the support wherein the spring comprises a spring having a wave shape configuration in a direction along the axis.

2. In a travelling-wave tube having a substantially cylindrically-shaped circuit section and a support for the circuit section, a method for forming a thermally conductive support between the circuit section and the support comprising the steps of:

forming a resilient biasing means, wherein said resilient biasing means comprises a spring, said biasing means having a specified radial dimension;

forming a groove having a specified radial dimension in the circuit section, wherein a space is formed between the circuit section and the support, wherein said biasing means radial dimension is greater than that defined by the space;

placing the biasing means under stress for reducing its dimension to less than that defined by the space;

inserting the reduced dimensioned biasing means into the space; and releasing the stress from the biasing means for permitting the biasing means to intimately contact the circuit section and the support wherein the spring comprises a helical spring.

3. In a travelling-wave-tube having an axis, and in which a substantially cylindrically-shaped circuit section is axially supported by a thermally conductive support within a tubular-configured vacuum wall, the improvement comprising:

means defining grooves in the circuit section extending in a direction along and positioned about the axis; and springs disposed in respective ones of said groove means and resiliently biased in intimate mechanical and thermal contact between said groove means and the vacuum wall wherein said springs are configured as helices having open interiors.

4. In a travelling wave-tube having an axis, and in which a substantially cylindrically-shaped circuit section is axially supported by a thermally conductive support within a tubular-configured vacuum wall, the improvement comprising:

means defining grooves in the circuit section extending in a direction along and positioned about the axis; and springs disposed in respective ones of said groove means and resiliently biased in intimate mechanical and thermal contact between said groove means and the vacuum wall in which said springs comprise helical springs.

5. In a travelling wave-tube having an axis, and in which a substantially cylindrically-shaped circuit section is axially supported by a thermally conductive support within a tubular-configured vacuum wall, the improvement comprising:

means defining grooves in the circuit section extending in a direction along and positioned about the axis; and springs disposed in respective ones of said groove means and resiliently biased in intimate mechanical and thermal contact between said groove means and the vacuum wall in which said springs have a wave shape configuration in a direction along the axis.

6. In a travelling wave-tube having an axis, and in which a substantially cylindrically-shaped circuit section is axially supported by a thermally conductive support within a tubular-configured vacuum wall, the improvement comprising:

means defining grooves in the circuit section extending in a direction along and positioned about the axis; and springs disposed in respective ones of said groove means and resiliently biased in intimate mechanical and thermal contact between said groove means and the vacuum wall further comprising a bonding agent bonding said springs to the vacuum wall and to said respective groove means.

7. The improvement according to claim 6 in which said bonding agent comprises gold.

8. The improvement according to claim 7 in which said springs comprise a material selected from the group consisting of molybdenum, tungsten, rhenium, dispersion hardened copper, and an alloy of tungsten and rhenium.

9. In a travelling-wave tube having a substantially cylindrically-shaped circuit section and a support for the circuit section, a method for forming a thermally conductive support between the circuit section and the support, comprising the steps of:

providing a space of specified radial dimension between the circuit section and the support;

providing a thermally conductive wire of spring material having a selected diameter;

providing first and second cylinders having respective diametrical dimensions such that the diametrical dimension of the first cylinder plus twice the diametrical dimension of the wire is greater than the dimension of the space and the diametrical dimension of the second cylinder plus twice the diametrical dimension of the wire is less than the dimension of the space;

wrapping the wire about the first cylinder for forming a helical spring having an outer diametrical dimension which exceeds that of the space;

removing the helical spring from the cylinder;

placing the helical spring about the second cylinder;

decreasing the diametrical dimension of the helical spring to a dimension which is less than that of the space, thereby placing the helical spring under stress;

affixing the helical spring to the second cylinder for maintaining the decreased diametrical dimension;

inserting the reduced dimensioned helical spring into the space; and releasing the stress from the helical spring for permitting the helical spring to intimately contact the circuit section and the support.

10. A method according to claim 9 in which said stress releasing step comprises the step of twisting the second cylinder for permitting the helical spring to expand into intimate contact between the circuit section and the support, and further comprising the step of removing the second cylinder from the helical spring.

11. A method according to claim 10 further comprising the steps of:

placing a bond-forming material on the helical spring after said wire wrapping step but prior to said spring removing step; and bonding the helical spring to the circuit section and the support, using the bond-forming material, after said second cylinder removing step.

12. A method according to claim 11 in which said material placing step comprises the step of plating the material on the helical spring, and said bonding step comprises the step of metallurgically diffusing the bond material into the circuit section and the support.

13. A method according to claim 12 wherein the helical spring is formed of molybdenum and the plating material comprises gold over nickel strike.

* * * * *